US012759768B2

(12) United States Patent
Wadsworth et al.

(10) Patent No.: US 12,759,768 B2
(45) Date of Patent: Oct. 13, 2026

(54) SIP AND POUR DRINKING SYSTEM

(71) Applicant: Hydrojug, Inc., Ogden, UT (US)

(72) Inventors: Hayden Wadsworth, Ogden, UT (US); Ethan Powell, Salt Lake City, UT (US); Ryan Holmes, West Haven, UT (US); Qiu Hui, Hangzhou (CN); Zhang Hui, Hangzhou (CN)

(73) Assignee: HYDROJUG, INC., Ogden, UT (US)

( * ) Notice: Subject to any disclaimer, the term of this patent is extended or adjusted under 35 U.S.C. 154(b) by 0 days.

(21) Appl. No.: 19/193,601

(22) Filed: Apr. 29, 2025

(65) Prior Publication Data

US 2026/0296743 A1 Oct. 1, 2026

Related U.S. Application Data

(63) Continuation-in-part of application No. 29/995,987, filed on Mar. 28, 2025, and a continuation-in-part of (Continued)

(51) Int. Cl.

| | |
|---|---|
| ***B65D 47/08*** | (2006.01) |
| ***B65D 51/18*** | (2006.01) |
| ***B65D 51/24*** | (2006.01) |

(52) U.S. Cl.

CPC ..... *B65D 47/0871* (2013.01); *B65D 51/18* (2013.01); *B65D 51/242* (2013.01); (Continued)

(58) Field of Classification Search

CPC ..... A47G 21/18; A47G 19/2272; A47G 19/2266; B65D 47/0871; B65D 47/0866; (Continued)

(56) References Cited

U.S. PATENT DOCUMENTS 4,448,316 A * 5/1984 Hiroshige ..... B65D 77/283 215/229
6,196,413 B1 3/2001 Chong
(Continued)

FOREIGN PATENT DOCUMENTS

JP 2017154780 A * 9/2017 ..... A47G 19/2288
WO WO2008046782 4/2008
WO WO2021256792 12/2021

OTHER PUBLICATIONS

Bottlezee/Moynuddin, We Tried the Best Water Bottle With Flip Lid And Here's The Result!, https://bottlezee.com/water-bottle-with-flip-lid/, May 16, 2024

*Primary Examiner* — Robert J Hicks
(74) *Attorney, Agent, or Firm* — Preston P. Frischknecht; Project CIP

(57) ABSTRACT

A sip and pour drinking system with one or more of a lid, straw assembly, and drinking container with tiers so that a user can: (1) open a first tier and sip a liquid from the container in a first configuration; and (2) open a second tier and pour a liquid from the drinking container in a second configuration. The lid body or base (representing a third tier) has a spout with first and second openings, the latter to retain a straw assembly with a mouthpiece configured to stop and bypass the first opening in the first configuration (for sipping) and unstop the first opening in the second configuration (for pouring). The drinking system also has structures and features for mitigating container pressure, including the first cover opening only slightly through a pushbutton latch assembly that opens the first cover in stages.

37 Claims, 15 Drawing Sheets

Related U.S. Application Data application No. 29/995,807, filed on Mar. 28, 2025, and a continuation-in-part of application No. 29/995,604, filed on Mar. 27, 2025, and a continuation-in-part of application No. 29/995,606, filed on Mar. 27, 2025, and a continuation-in-part of application No. 29/995,320, filed on Mar. 26, 2025, and a continuation-in-part of application No. 29/995,174, filed on Mar. 25, 2025.

(52) U.S. Cl.
CPC ..... *B65D 2251/0025* (2013.01); *B65D 2251/0087* (2013.01)

(58) Field of Classification Search
CPC ..... B65D 47/0861; B65D 47/0857; B65D 47/08; B65D 51/18; B65D 43/169; B65D 2251/0053; B65D 2251/0025; B65D 2251/0087
USPC ..... 220/212.5, 212, 254.6, 254.3, 254.2, 220/254.1, 708, 707, 705; 215/229
See application file for complete search history.

(56) References Cited

U.S. PATENT DOCUMENTS

| | | | | |
|---|---|---|---|---|
| 8,333,290 | B2 | 12/2012 | Kuwahara | |
| 8,905,252 | B2 | 12/2014 | Latham | |
| 8,939,312 | B1 | 1/2015 | Buck | |
| 9,078,535 | B1 | 7/2015 | Buck | |
| 10,004,348 | B2 | 6/2018 | Sorensen | |
| 10,172,488 | B2 | 1/2019 | Sorensen | |
| 10,421,589 | B1 | 9/2019 | Quinn | |
| D863,877 | S | 10/2019 | Meyers | |
| 10,524,597 | B2 | 1/2020 | Sorensen | |
| D886,521 | S | 6/2020 | Meyers | |
| 10,687,641 | B2 | 6/2020 | Sorensen | |
| D911,104 | S | 2/2021 | Meyers | |
| 11,278,139 | B2 | 3/2022 | Sorensen | |
| 11,510,512 | B2 | 11/2022 | Pinelli | |
| D996,897 | S | 8/2023 | Meyers | |
| 12,201,230 | B2 | 1/2025 | Bell | |
| 2003/0136783 | A1* | 7/2003 | Hatsumoto | A47J 41/0027 215/237 |
| 2005/0133519 | A1* | 6/2005 | McDonough | A47G 19/2266 220/705 |
| 2006/0102628 | A1* | 5/2006 | Hage | A01K 7/06 220/709 |
| 2012/0312832 | A1* | 12/2012 | Lane | B65D 51/242 220/774 |
| 2013/0087571 | A1* | 4/2013 | Yao | A47G 21/18 220/709 |
| 2015/0201775 | A1* | 7/2015 | Sorensen | B65D 43/26 220/254.1 |
| 2017/0101231 | A1* | 4/2017 | George | A47J 41/0022 |
| 2021/0039846 | A1* | 2/2021 | Jinkins | B65D 51/18 |
| 2022/0332478 | A1* | 10/2022 | Meyers | A47G 19/2272 |
| 2023/0109934 | A1 | 4/2023 | Huang | |
| 2023/0356893 | A1 | 11/2023 | Steinmann | |
| 2024/0366005 | A1 | 11/2024 | Sorensen | |
| 2025/0074683 | A1 | 3/2025 | Shi | |

* cited by examiner

SIP AND POUR DRINKING SYSTEM

RELATED APPLICATIONS

This application is a continuation-in-part of, and claims priority to several United States design patent applications, including application numbers:

Ser. No. 29/995,174, filed on Mar. 25, 2025;
Ser. No. 29/995,320, filed on Mar. 26, 2025;
Ser. No. 29/995,604, filed on Mar. 27, 2025;
Ser. No. 29/995,606, filed on Mar. 27, 2025;
Ser. No. 29/995,807, filed on Mar. 28, 2025; and
Ser. No. 29/995,987, filed on Mar. 28, 2025.

These applications (and their contents) are specifically incorporated herein.

BACKGROUND OF THE INVENTION

Reusable drinking containers and water bottles are increasingly popular, in part, due to a desire to drink water as the beverage of choice (for health reasons) as part of an active lifestyle and to be more environmentally friendly by avoiding disposable, more single use containers. Despite myriad drinking container variations in the prior art and within this market, varietal demand is seemingly unending, and users crave novel functionality and design. To illustrate, one broad category of simple reusable drinking containers are those drinking containers incorporating a lid that allows a user to pour liquid from the container in order to drink. Another category is represented by drinking containers configured to use a straw as an integral part of the system from which a user may sip to drink. There is some crossover in these categories. For example, drinking systems of the first category may be retrofitted to the second category through aftermarket and/or straw accessory purchases. Other crossover solutions are operationally and aesthetically complicated and reliability-disadvantaged by mechanisms like internal valves and valve selectors. There is a noticeable absence of product configurations whereby a user has the option of readily selecting between optimized pour and sip drinking functionality in a single, out-of-the-box drinking system.

Another, totally different issue—known by some as "the geyser problem"—is found within drinking containers and water bottles. Specifically, some conditions result in pressurization within drinking containers and water bottles that, when opened by a user, spray contents out of the container (including on the user) when the containers and/or bottles are opened. Such pressurization can occur when a filled drinking container changes elevation (from, for example, going from a lower to a higher elevation). In another example, the liquid contents of a drink container pressurize the closed container because they are carbonated.

Given the above, what is needed is a new drinking container with a novel, out-of-the box pour and sip drinking functionality that mitigates the geyser problem.

SUMMARY OF THE INVENTION

In accordance with the above, a new and innovative sip and pour drinking system is provided. Sip and pour functionality and geyser mitigation are achieved by a drinking system with one or more of a lid, straw assembly, and drinking container with tiered configurations so that a user can: (1) open a first tier and sip a liquid from the container in a first configuration; and (2) open a second tier and pour a liquid from the drinking container in a second configuration. The lid body (representing a third tier) has a spout with first and second openings, the second opening configured to retain a straw assembly with a mouthpiece that stops and bypasses the first opening in the first configuration (for sipping) and unstops the first opening in the second configuration (for pouring). The drinking system also has structures and features for mitigating container pressure, including the first cover opening only slightly through a pushbutton latch assembly that opens the first cover in stages.

These and other aspects of the present invention will become more fully apparent from the following description and appended claims or may be learned by the practice of the invention as set forth hereinafter.

BRIEF DESCRIPTION OF THE FIGURES

To further clarify the above and other aspects of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The drawings may not be drawn to scale. The invention will be described and explained with additional specificity and detail through the use of the accompanying drawings in which.

DETAILED DESCRIPTION OF THE ILLUSTRATED EMBODIMENT

The present invention in its various embodiments, some of which are depicted in the figures herein, is a sip and pour drinking system. Broadly, the drinking system may include one or more of a lid, straw assembly, and drinking container. The lid has tiered configurations so that a user can: (1) open the first tier to sip a liquid from the container in a first configuration; and (2) open a second tier to pour a liquid from the drinking container in a second configuration. The lid base (or third tier) has a spout with first and second openings. The second opening is configured to retain a straw assembly with a mouthpiece that stops and bypasses the first opening in the first configuration (for sipping) and unstops the first opening in the second configuration (for pouring). The drinking system may also include structures and features for mitigating pressurization in the system through staged opening, including initial first cover ajarment, through a pushbutton latch assembly.

Figure 15:
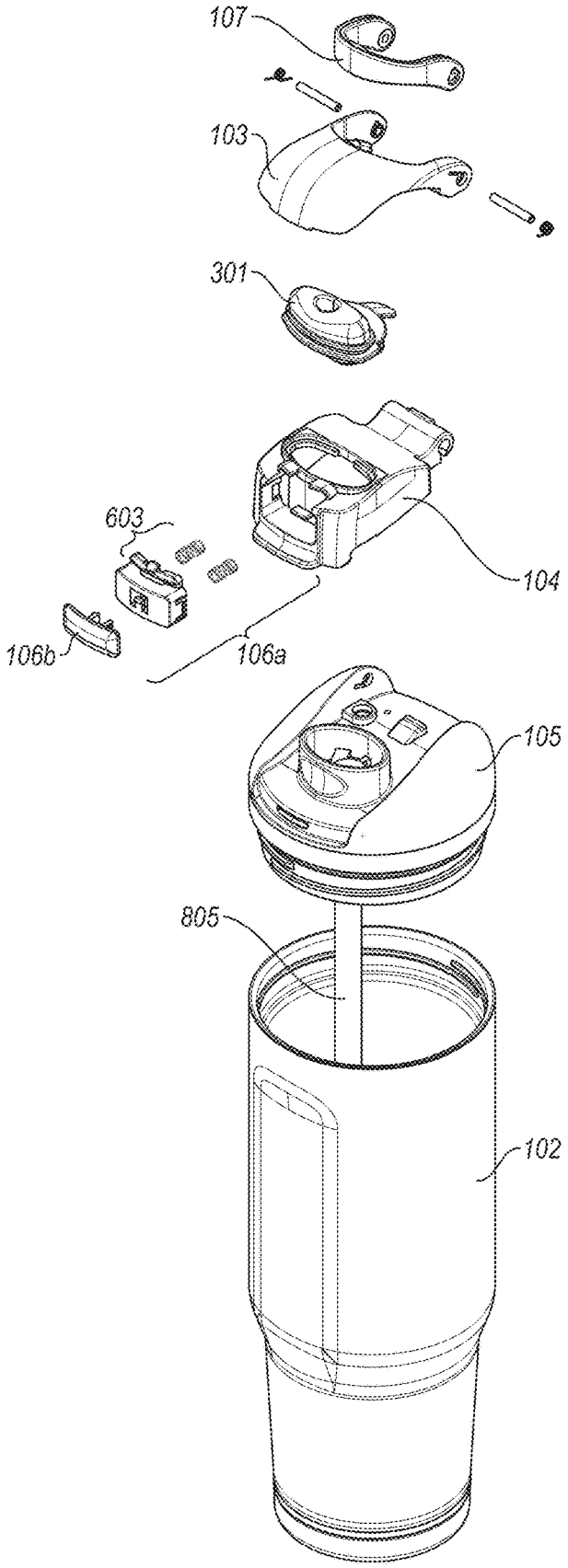
FIG. 15 is an exploded view of one embodiment of a drinking system.

Referring now to FIGS. 1 to 5, one embodiment of the drinking system 100 is shown with a lid 101 and a drinking container 102. Lid 101 may have first 103 and second 104 pivotably releasable covers attached to a lid base and/or body 105. In the illustrated embodiment, the first pivotably releasable cover 103 is connected to a pushbutton latch assembly 106*a* with a pushbutton 106*b* by which a user may open the first pivotably releaseable cover 103. First pivotably releasable cover 103 may be spring biased (to open) through springs adjacent a pivot point (see FIG. 15, between 103 and 107). Second pivotably releasable cover 104 may have a front lip and/or protrusion 108 by which a user may manually open the second pivotably releasable cover 104 (otherwise retained or latched, see, e.g., FIGS. 6-11 and compare with FIGS. 4, 5 and 12). Lid 101 may also have a pivotable carry loop 107 that is stowable within the lid 101 in a first position A, and extendable therefrom in a second position B.

Figure 1:
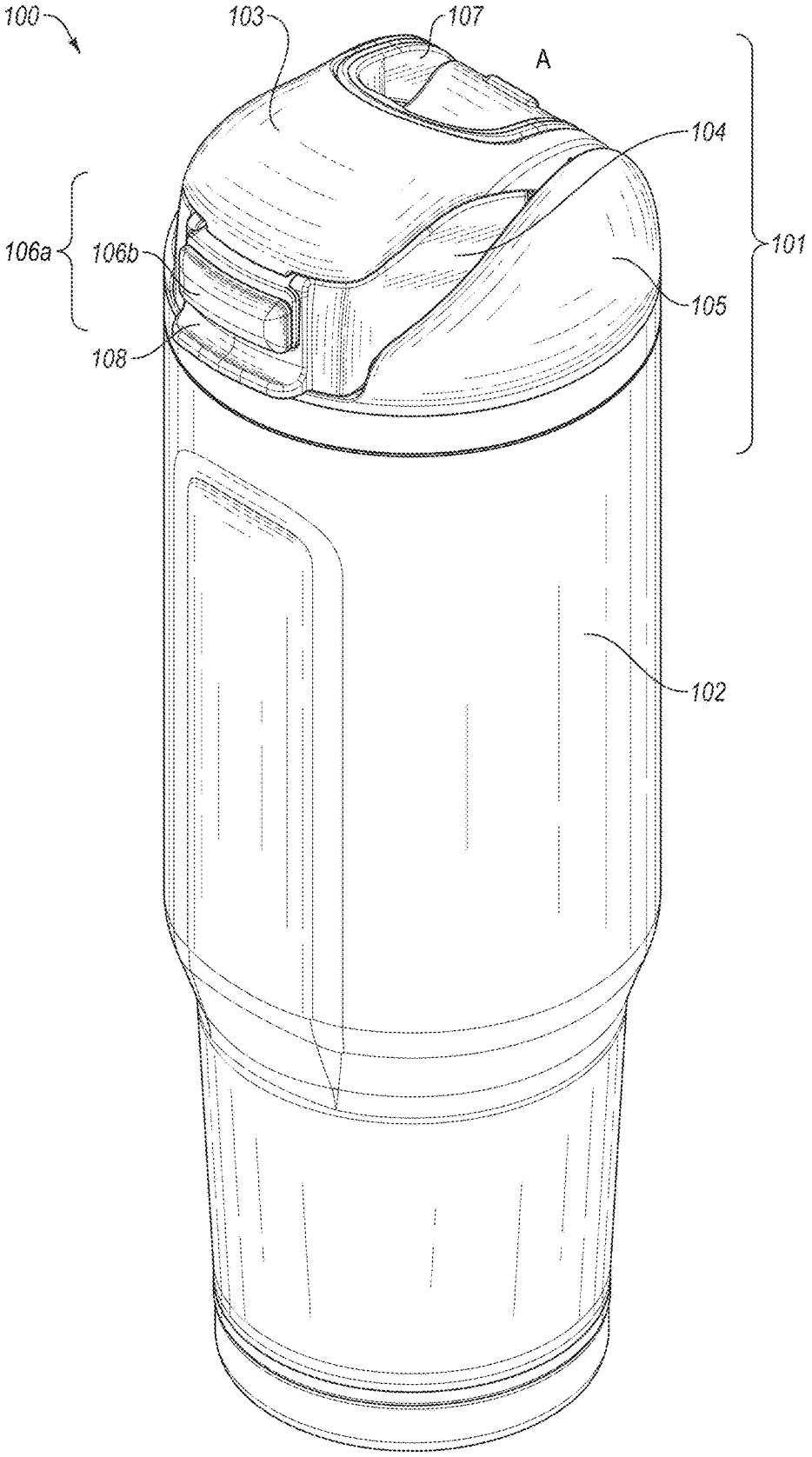
FIG. 1 is a perspective view of one embodiment of a drinking system.
Figure 2:
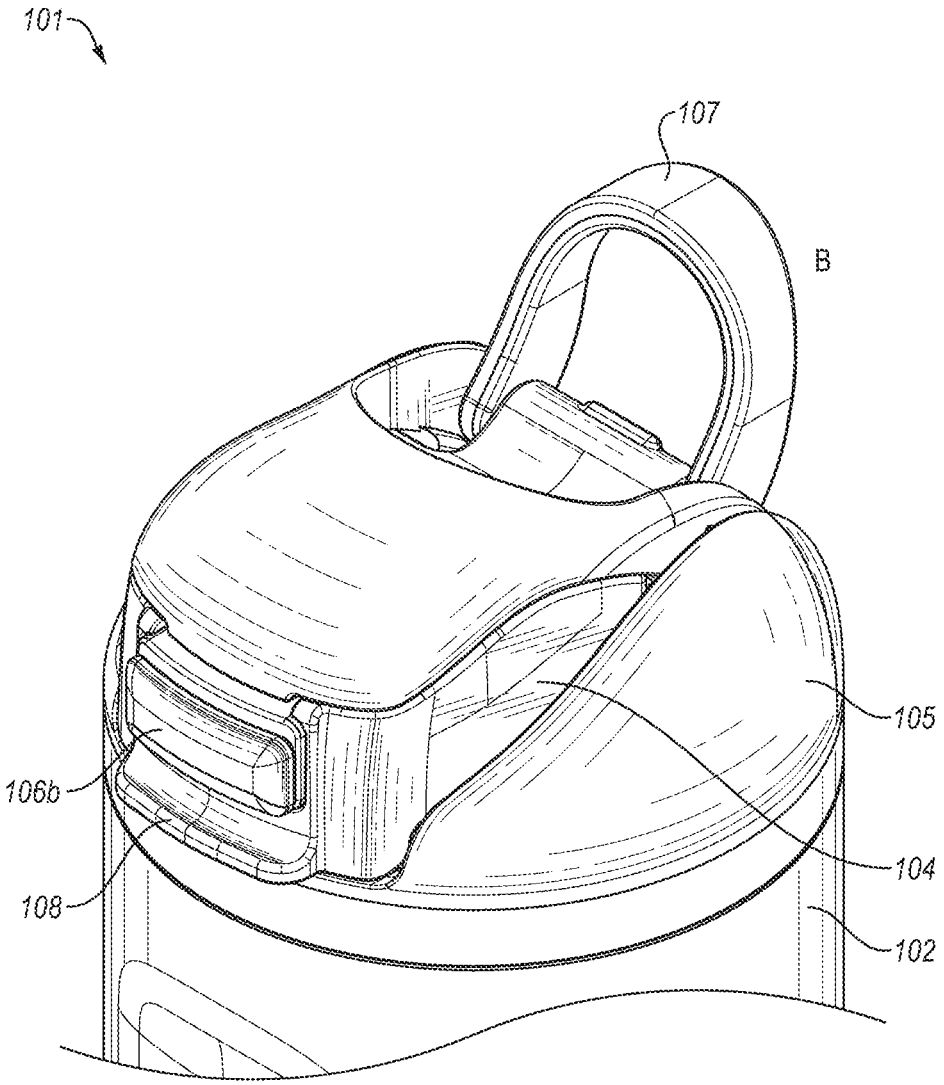
FIG. 2 is a perspective view of a lid in a first position in one embodiment of a drinking system with a carry loop up.
Figure 3:
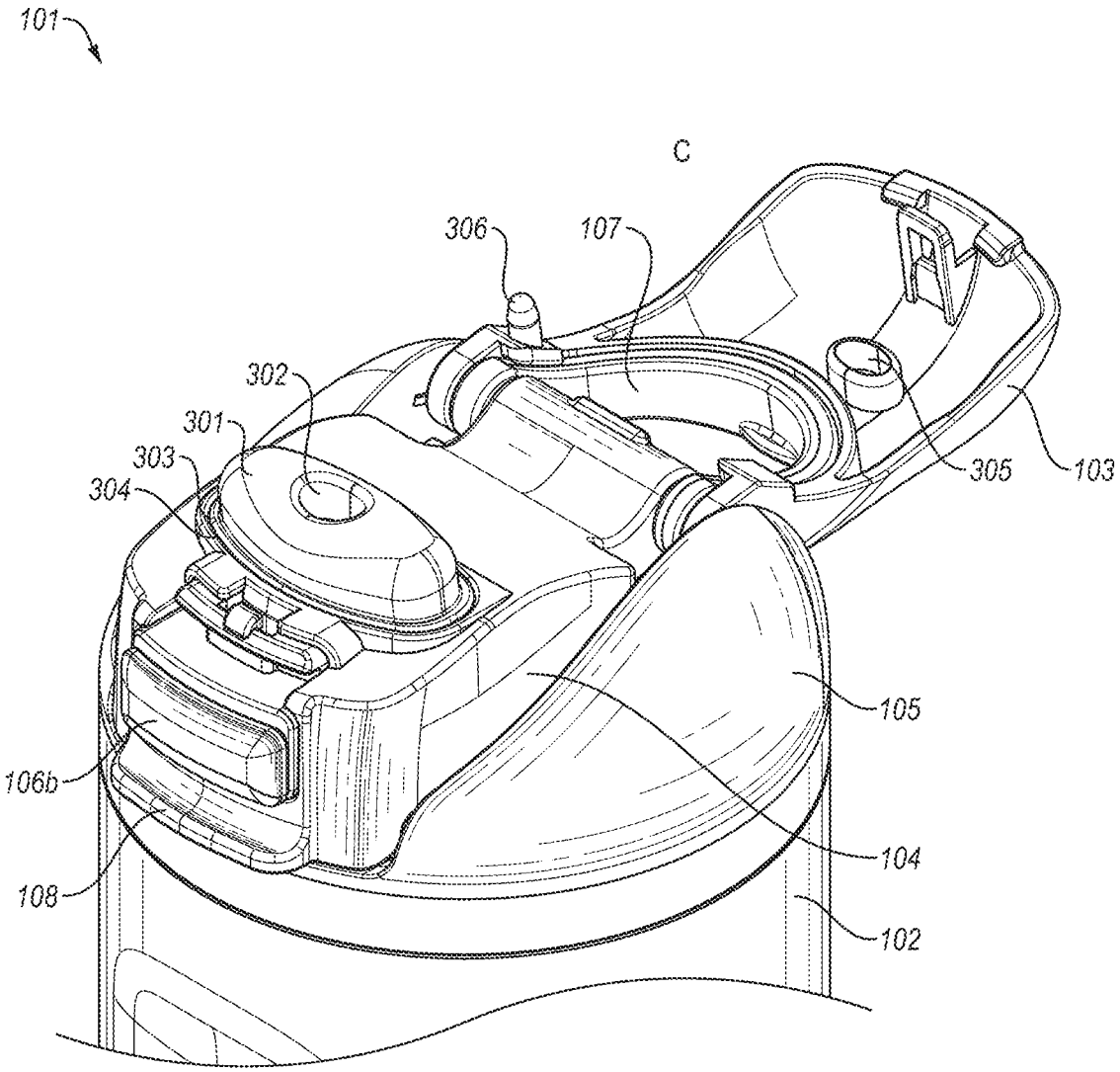
FIG. 3 is a perspective view of a lid in a second (sip) position with a first cover open in one embodiment of a drinking system.
Figure 4:
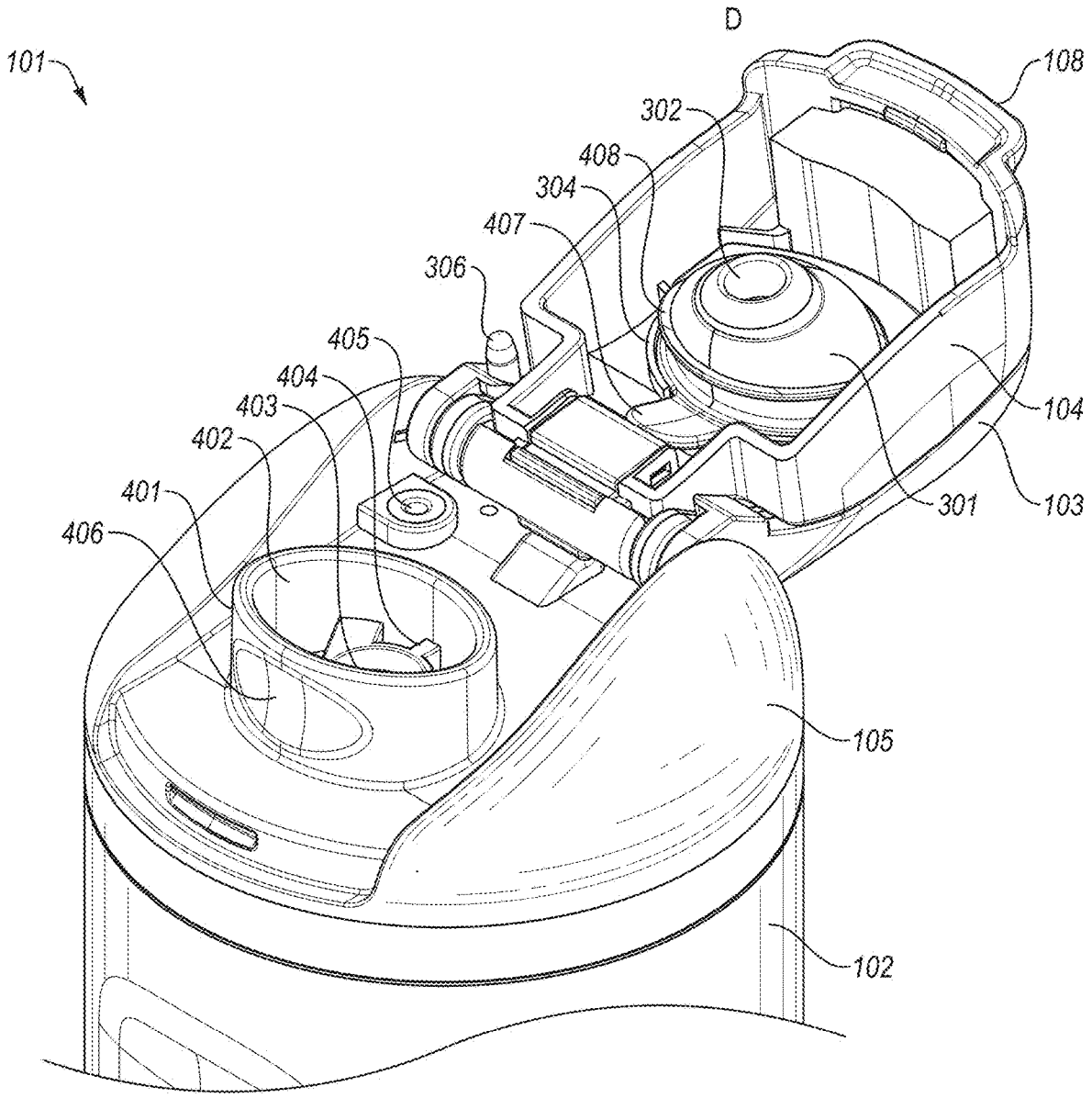
FIG. 4 is a perspective view of a lid in a third (pour) position with a second cover open in one embodiment of a drinking system.
Figure 5:
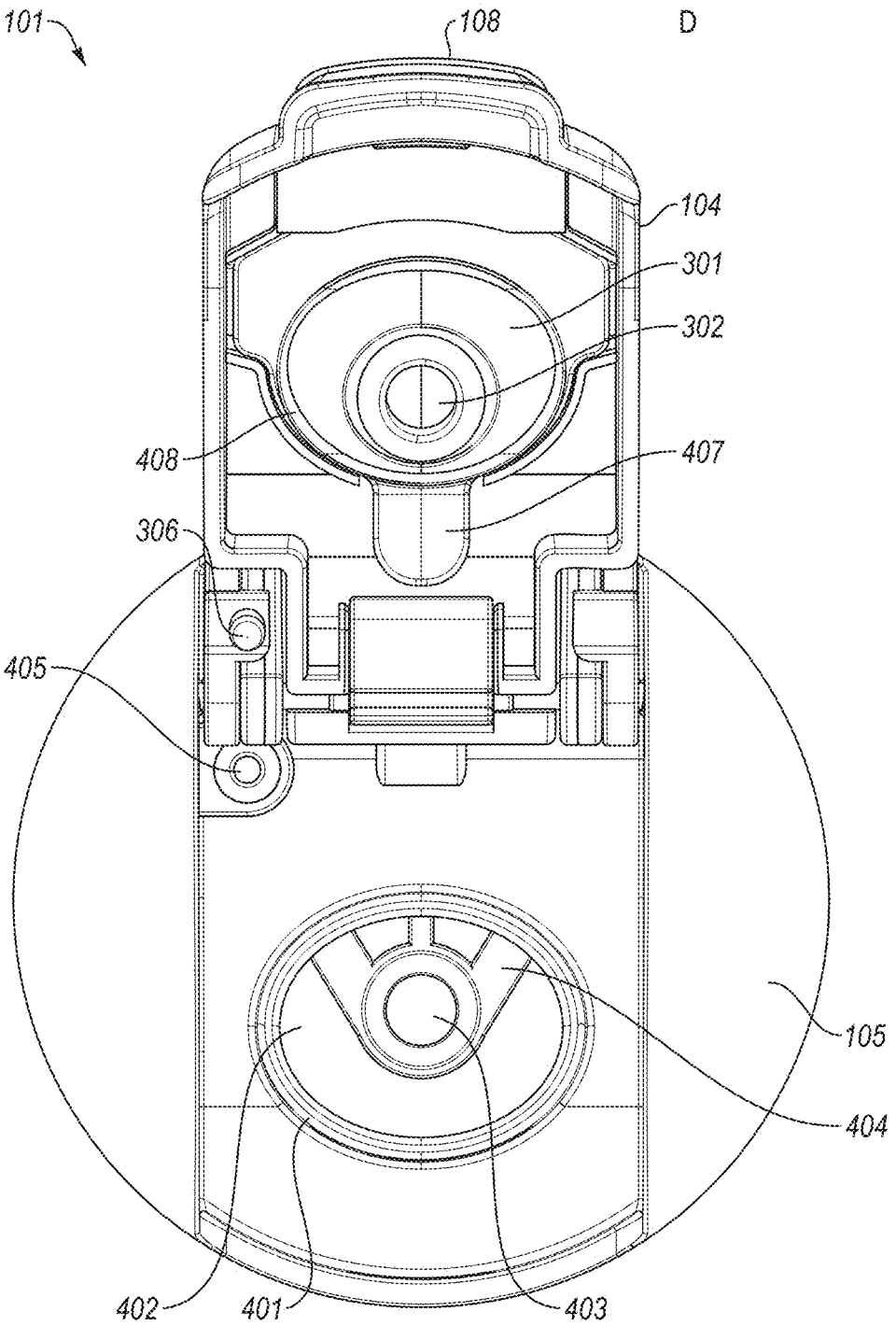
FIG. 5 is a top view of a lid in the third (pour) position with the second cover open in one embodiment of a drinking system.

Referring now to FIGS. 3-4, opening the first pivotably releaseable cover 103 achieves a configuration C by which a user may sip liquid from the drinking container 102 as a first means of drinking. In particular, the second tier of the system 100 has a mouthpiece 301 adjacent and/or connectable to a straw (see 805 in FIGS. 8-12) in a straw assembly that extends downward into the drinking container 102. Mouthpiece 301 has a drinking aperture 302 configured to be in communication with the straw 805. In preferred embodiments, mouthpiece 301 is made of a non-rigid and/or flexible material and is releasably retainable within the second pivotably releasable cover 104 through an aperture 304 that passes therethrough. Mouthpiece 301 may have first 303 and second 408 flanges around it to facilitate retention and to prevent spillage between the various tiers, covers, and or connections of the system. Mouthpiece 301 may have a tab 407 for a user to grasp/pull/remove the mouthpiece 301 (for cleaning, for example) from the underside of the second pivotably releasable cover 104.

The underside of the first pivotably releasable cover 103 may have a protrusion 305 to plug the mouthpiece aperture 302 when the first pivotably releaseable cover 103 is closed (in configuration A). The underside of first pivotably releasable cover 103 may also have a plug 306 configured to stop a vent opening 405 in the lid 101 (again, when the first cover 103 is closed) that otherwise facilitates the flow of liquid from the container 102 to a drinking user (see also FIGS. 13 and 14).

Referring specifically to FIG. 4, opening the second pivotably releaseable cover 104 achieves a configuration D by which a user may pour liquid from the drinking container 102 as a second means of drinking. In this configuration, the sipping function may be inoperable; in the illustrated embodiment, for example, it is (and must be) inoperable. Lid body 105 has a spout 401 with a first opening 402 for pouring liquid from the drinking container 102 and a second opening 403 configured to retain the straw 805. An integrally formed bracket 404 may connect the first 402 and second openings 403. In normal operation, straw 805 is configured to be retained within the lid body 105 and/or container 102, but may be removable therefrom for cleaning or other purposes. Spout 401 may have a recess 406 that is configured to accommodate a user's lower lip. Second opening 403 may be located within first opening 402 and have a smaller diameter than the first opening 402. As viewed from above (in, e.g., FIG. 5), second opening 403 may not be tangent to first opening 402. The top surface of the second opening 403 may be below the top surface of the first opening. Second opening 403 may be circular in shape (and in the illustrated embodiment, must be) and first opening 402 may be elliptical in shape (and in the illustrated embodiment, must be). However, embodiments of the system may vary and any number of different shapes may be incorporated for these features without departing from the purpose and scope of the invention.

Figure 11:
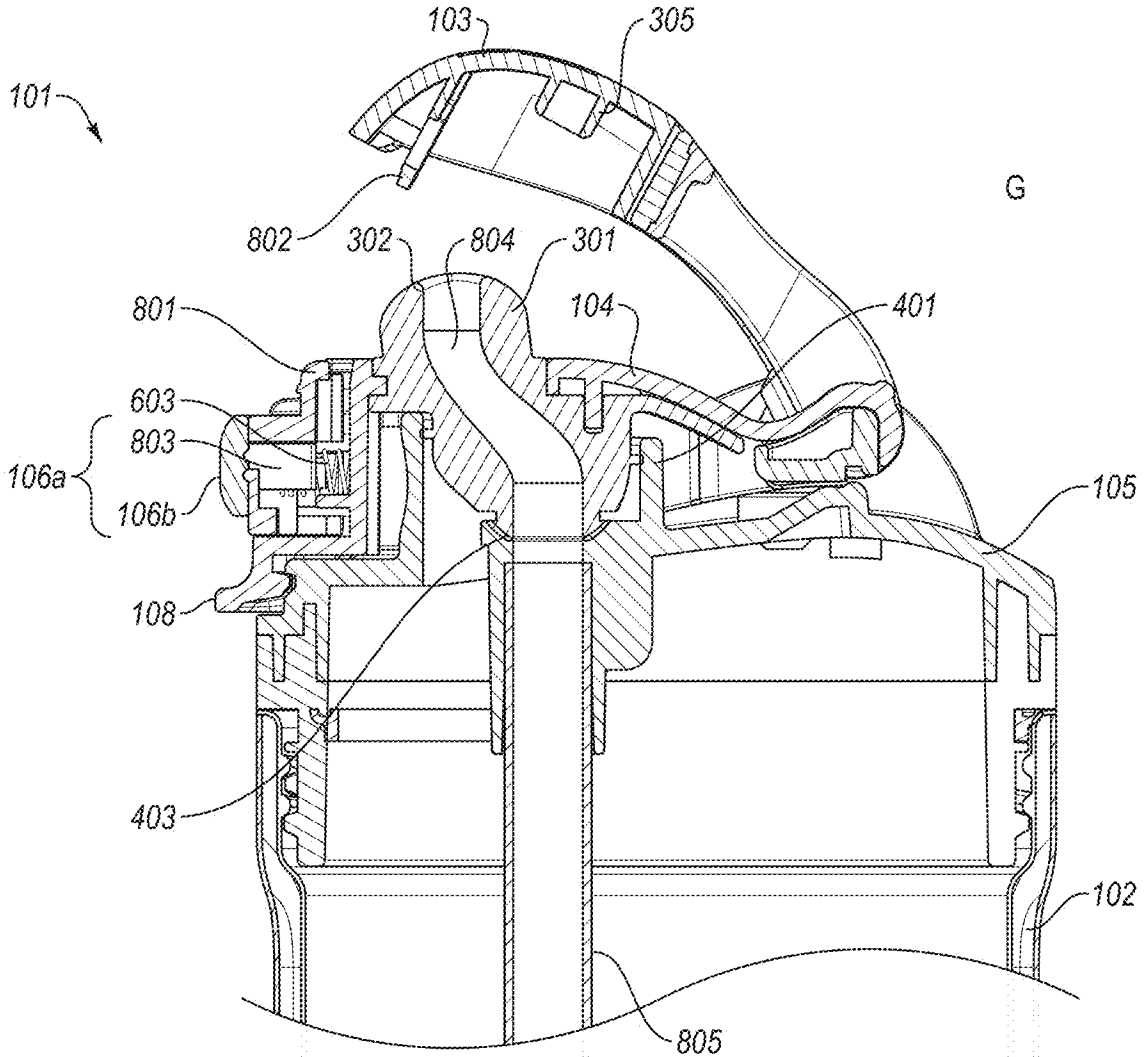
FIG. 11 is a sixth (center) cross-section view of a lid in one embodiment of a drinking system that shows the pushbutton latch assembly in a fourth position.
Figure 12:
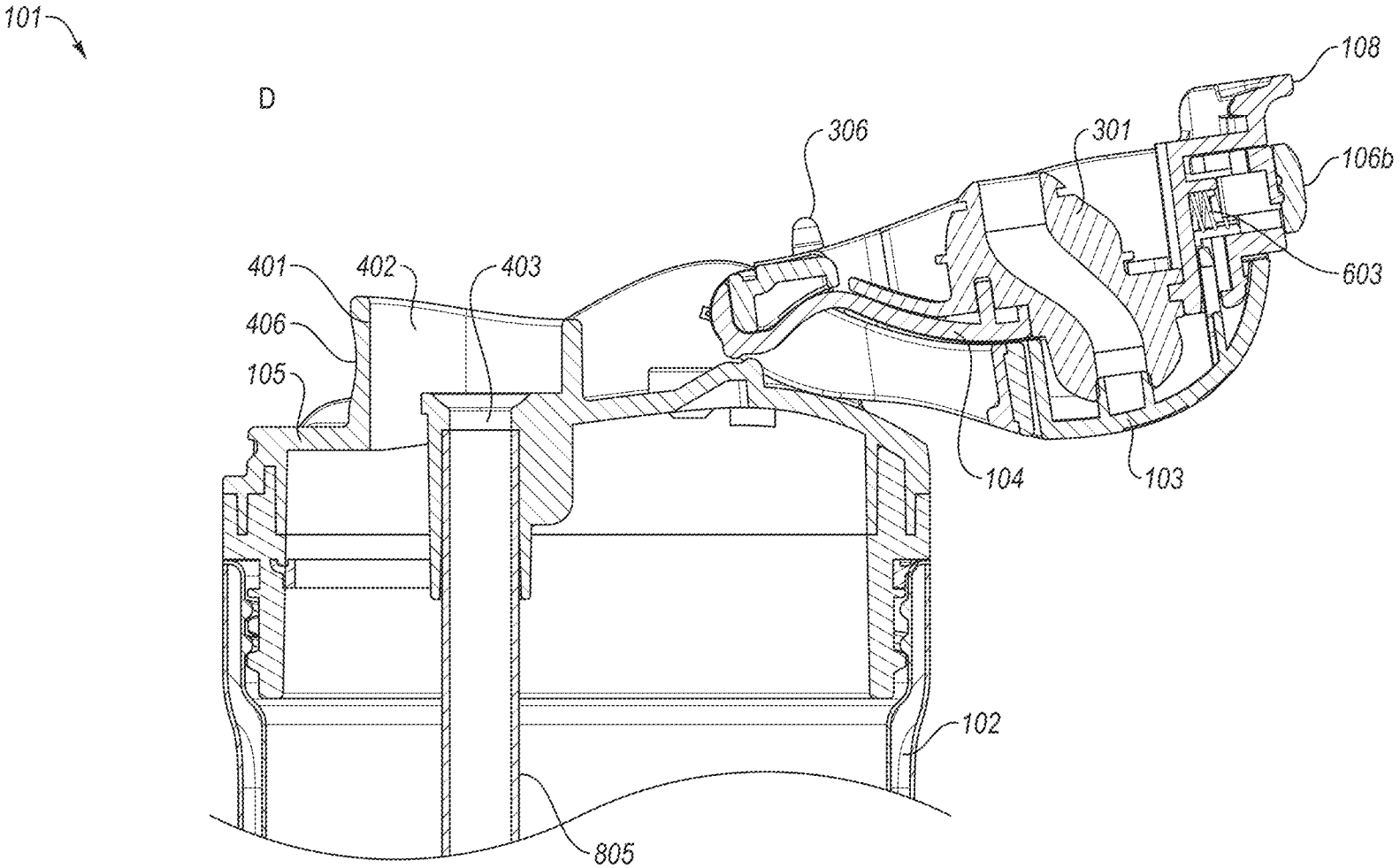
FIG. 12 is a seventh (center) cross-section view of a lid with the second cover open in one embodiment of a drinking system.

Referring briefly to FIGS. 3 and 11, with the second pivotably releasable cover 104 down, retained, and/or latched, a bottom end of mouthpiece 301 forms a seal around second opening 403 so that a user can sip liquid contents from the container 102 through the mouthpiece aperture 302 as liquid is conveyed through a continuous passageway 804 formed by the straw 805 and mouthpiece 301. In this configuration (e.g., A, B, C), mouthpiece 301 fully stops, plugs, and bypasses the first opening 402 such that liquid contents in the container 102 cannot move through the first opening 402 other than through the mouthpiece aperture 302, second opening 403, straw 805, and/or continuous passageway 804. Referring now to FIGS. 4 and 12, in the configuration D where the second pivotable cover 104 is opened, mouthpiece 301 is releasably attached thereto and conveyed therewith, thereby unplugging and/or unstopping the second opening 402, and allowing liquid contents to be poured from the container 102.

Referring now to FIGS. 6-14, the latching mechanism (including pushbutton latch assembly 106*a* with spring 603) and various stages thereof are explained in more detail. In some embodiments, the drinking system 100 and pushbutton latch assembly 106*a* are configured for staged opening of the first pivotable cover 103 when a user depresses a button 106*b*. In a first stage, the first pivotably releasable cover 103 is ajarred (e.g., position E). This allows pressure (if any) to be released from the drinking container while the cover 103 still encases or enshrouds the mouthpiece aperture 302 and/or vent opening 405 in such a way as to contain liquid upspray (if any). In a second stage, the first pivotable cover 103 fully opens to provide access to the mouthpiece 301 (e.g., position C).

Figure 6:
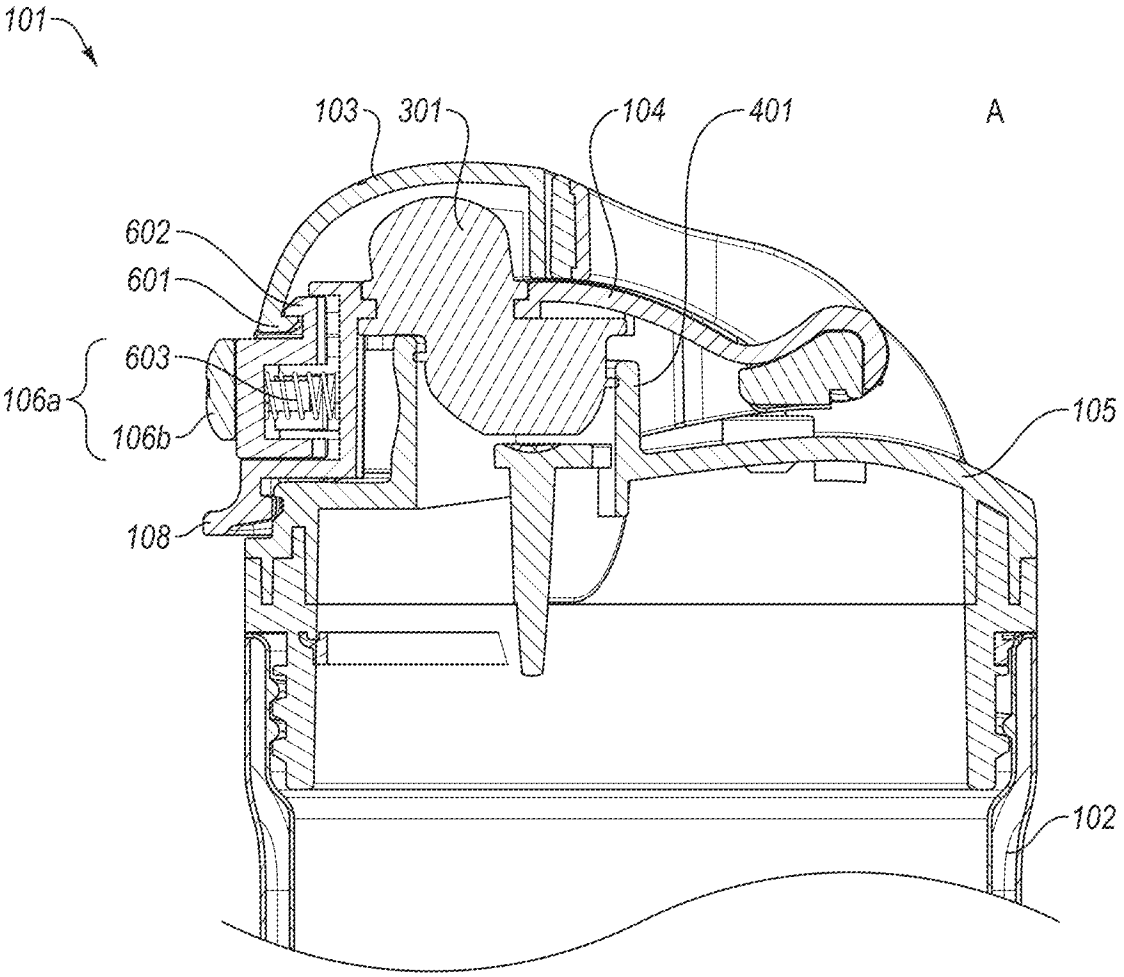
FIG. 6 is a first (off-center) cross-section view of a lid in one embodiment of a drinking system that shows a pushbutton latch assembly in a first position.
Figure 7:
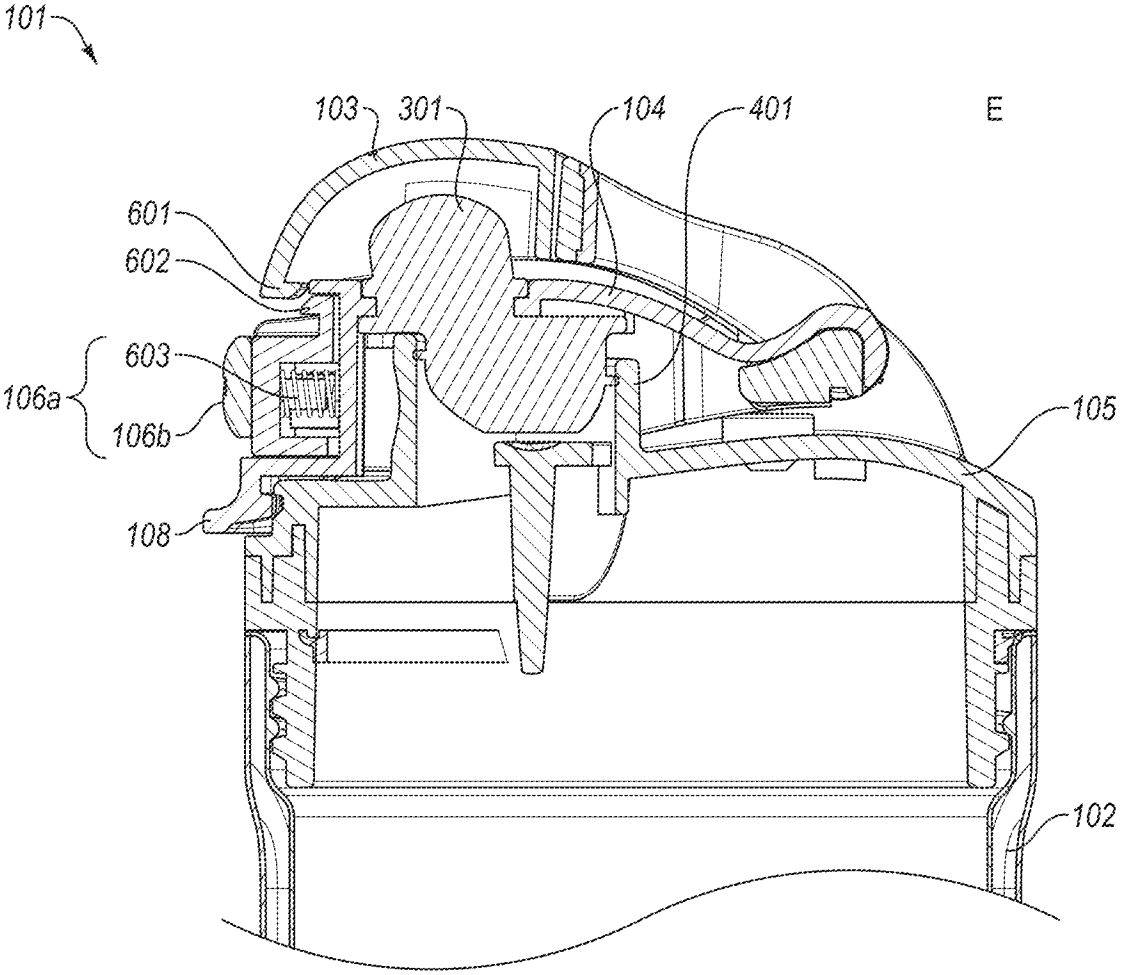
FIG. 7 is a second (off-center) cross-section view of an ajarred lid in one embodiment of a drinking system that shows a pushbutton latch assembly in a second position.
Figure 8:
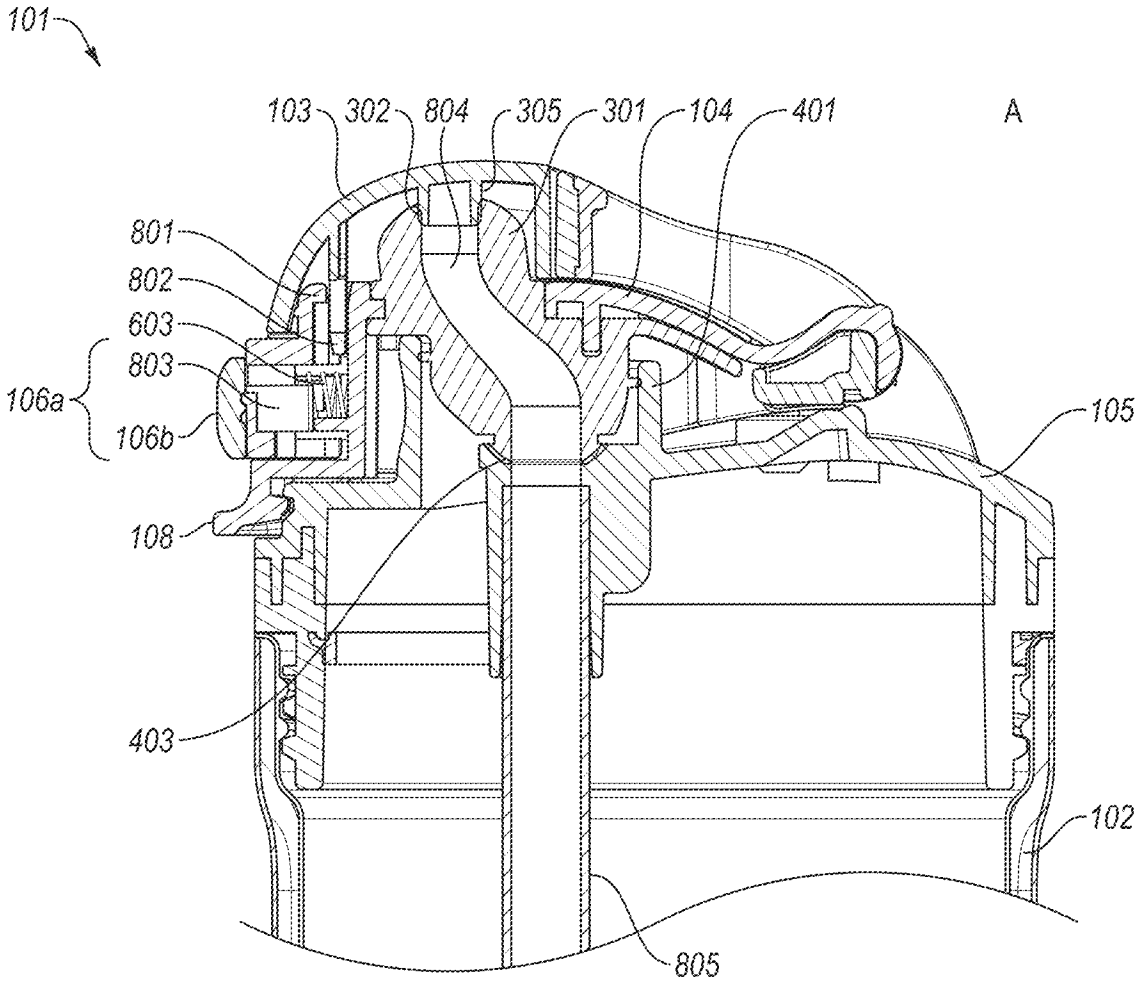
FIG. 8 is a third (center) cross-section view of a lid in one embodiment of a drinking system that shows a pushbutton latch assembly in a first position.
Figure 9:
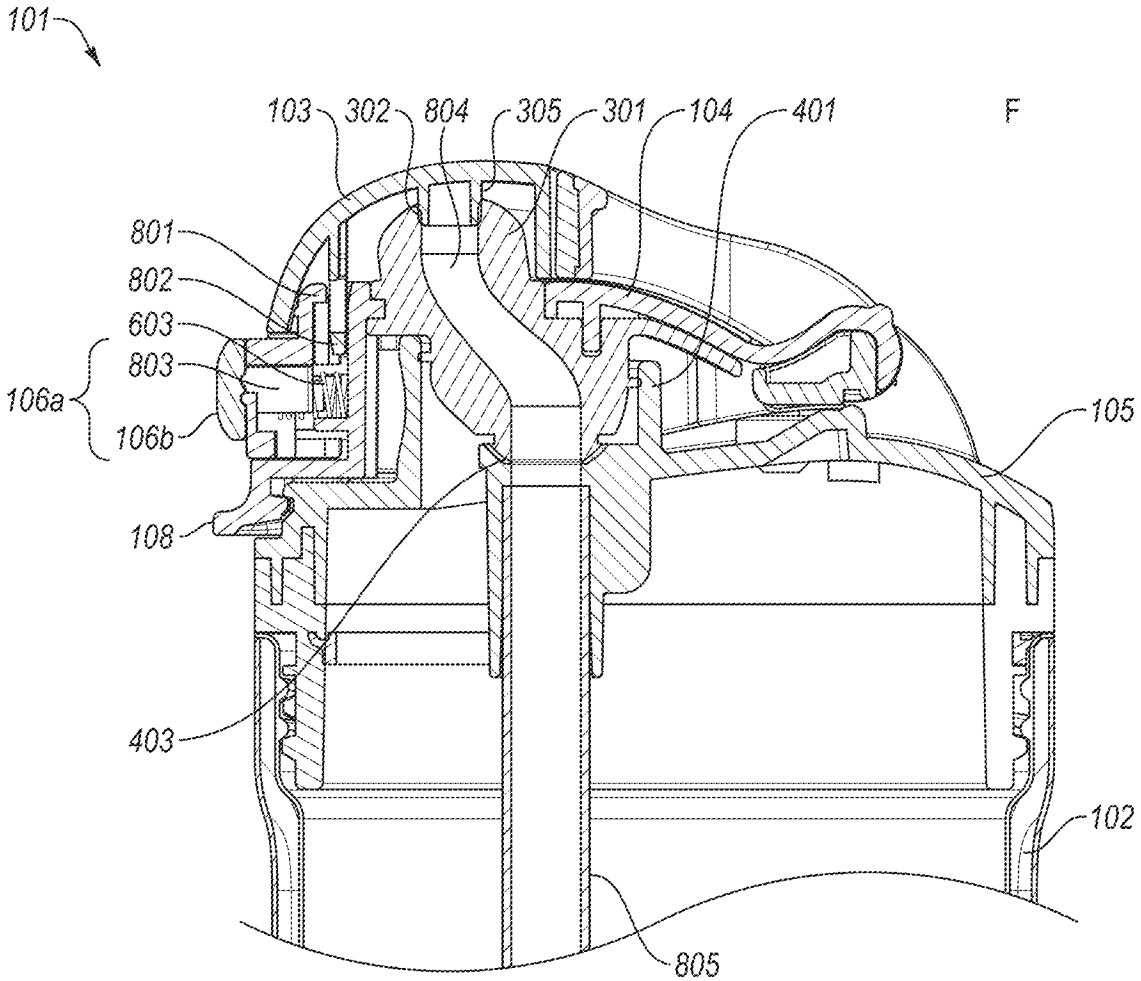
FIG. 9 is a fourth (center) cross-section view of a lid in one embodiment of a drinking system that shows a pushbutton latch assembly in a third position.
Figure 10:
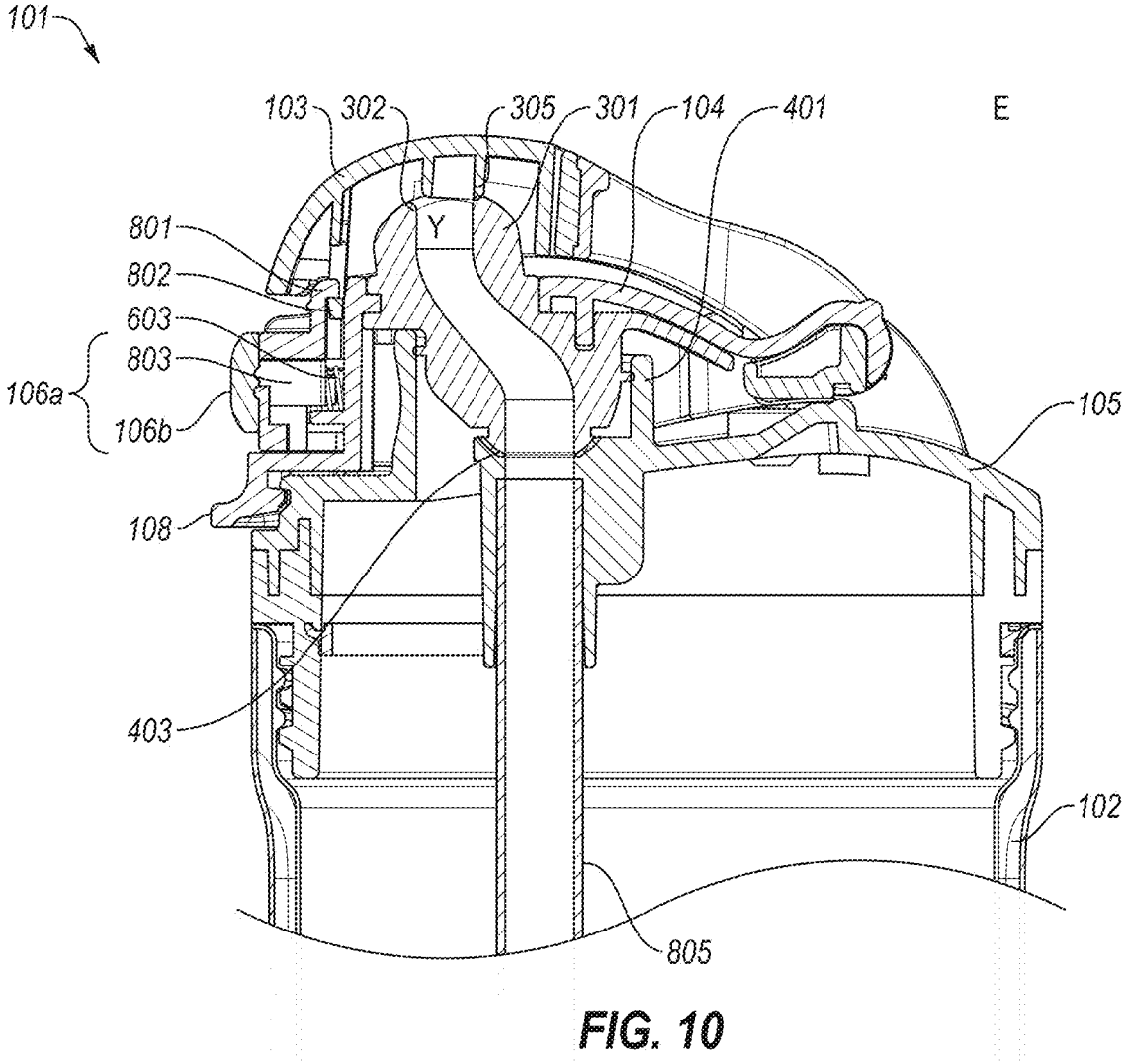
FIG. 10 is a fifth (center) cross-section view of an ajarred lid in one embodiment of a drinking system that shows the pushbutton latch assembly in a second position.
Figure 13:
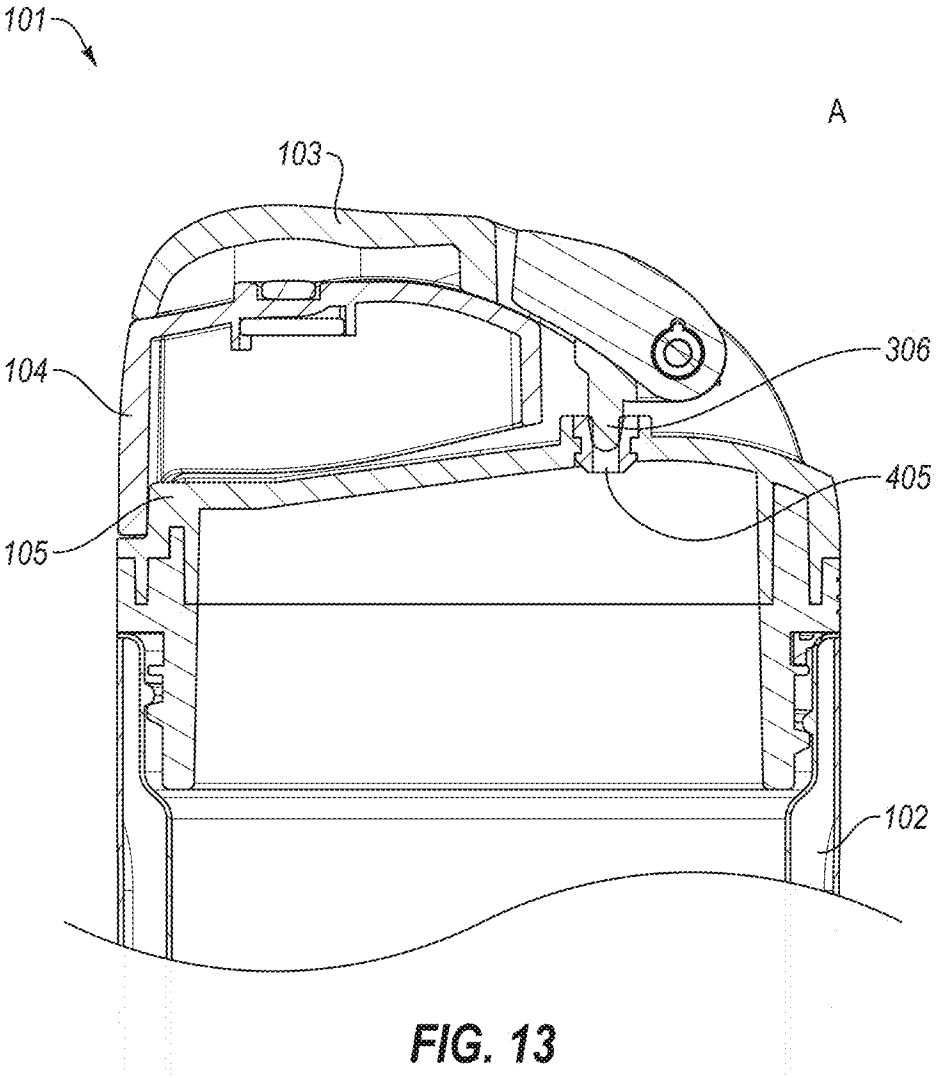
FIG. 13 is a eighth (off-center) cross-section view of a lid with a vent in one embodiment of a drinking system.
Figure 14:
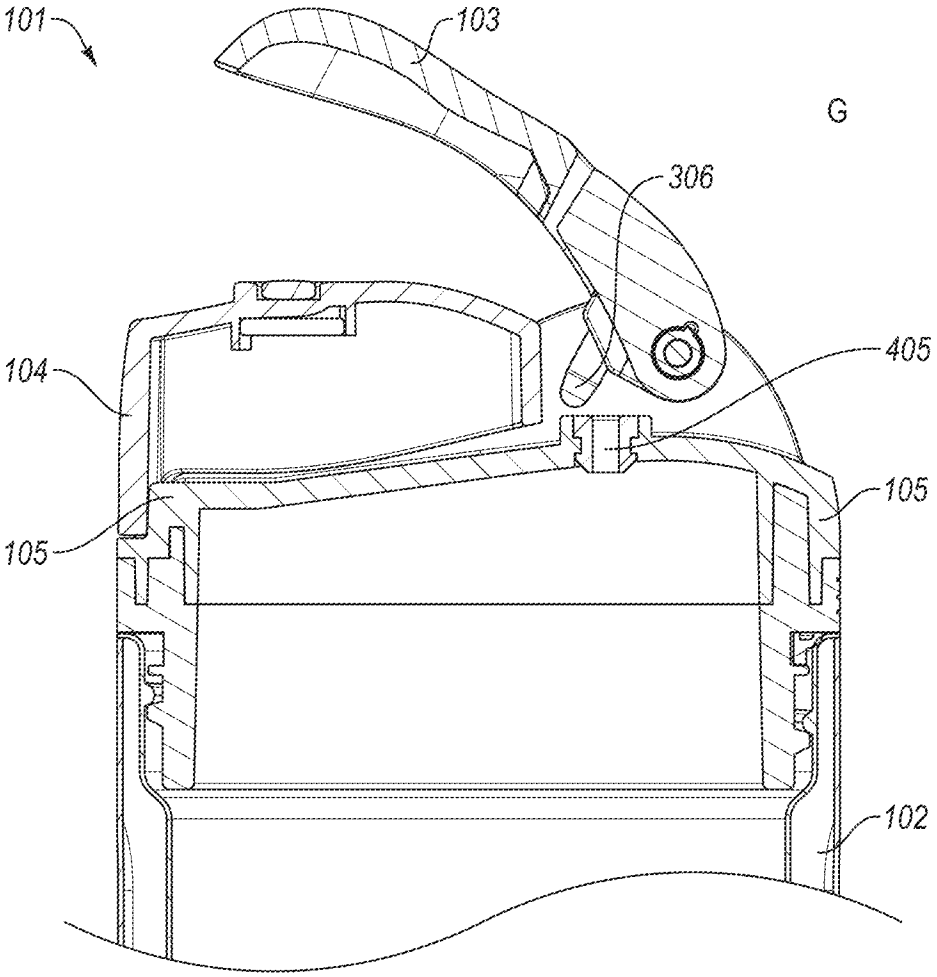
FIG. 14 is a ninth (off-center) cross-section view of a lid with a vent in one embodiment of a drinking system.

In FIGS. 6 and 7, the first pivotably releasable cover 103 is in a fully closed position (A) accomplished, at least in part, by a first latch portion 601 on the underside of the first cover 103 that engages a second latch portion 602 located in the pushbutton latch assembly 106*a*. As a user depresses the pushbutton 106*b* (to F & E), the second latch portion 602 disengages from the first latch portion 601 to slightly open and/or ajar the first pivotably releasable cover 103 from the second pivotably releaseable cover 104. By ajarring the first pivotably releasable cover 103 in this manner, one or more apertures of the lid are opened slightly. Referring briefly to FIG. 10, first, the protrusion 305 is removed from the mouthpiece aperture 302 to partially uncover the latter and to form a small sub-opening Y. Referring briefly to FIGS. 13 and 14, second, the protrusion 306 may be simultaneously removed from the vent aperture 405 and may also form a small sub-opening to release internal pressure.

Referring now to FIGS. 8-11, in the first stage, the first pivotably releasable cover 103 is releasably retained in the ajarred position E by third 801 and fourth 802 latch portions. As a user continues to depress the pushbutton (from F, E to G), the third 801 and fourth 802 latch portions disengage and the first pivotably releaseable cover 103 may spring open (G to C) to reveal the mouthpiece 301 and/or second pivotably releasable cover 104.

Depending on the embodiment, the drinking system 100 may include the lid 101 only, the lid 101 with the mouthpiece only 301, the lid 101 with the mouthpiece 301 and straw 805 (i.e. straw assembly), and/or all of the lid 101, mouthpiece 301, straw assembly 301, 805, and container 102. Container 102 is typically comprised of a body with a reservoir configured to hold a liquid. Container may be constructed of any number of materials, but preferably, embodiments include bodies of metal (such as, for example, stainless steel) and/or glass (such as, for example, borosilicate). In embodiments wherein the body 102 is metal, the body may incorporate multiple layers, insulation, and/or vacuum sealed construction and have silicone/non-slip rubber bases.

Thus configured, the problem of achieving a new drinking container with out-of-the-box pour and sip functionality and pressurization mitigation is solved.

The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A drinking system comprising:
- a lid for a drinking container, the lid with a body having a spout with
  - a first opening with a diameter, and
  - a second opening located within the first opening and having a diameter smaller than the first opening diameter.

2. The drinking system of claim 1, wherein the first opening is configured for pouring a liquid from the drinking container to a user's mouth.

3. The drinking system of claim 1, wherein the second opening is configured to retain a straw so that a user can sip liquid from the drinking container.

4. The drinking system of claim 1, wherein a top surface of the second opening is below a top surface of the first opening.

5. The drinking system of claim 1, wherein the spout has a recess that is configured to accommodate a user's lower lip.

6. The drinking system of claim 1, wherein the second opening is circular in shape.

7. The drinking system of claim 1, wherein the first opening is elliptical in shape.

8. The drinking system of claim 1, further comprising a bracket that connects the second opening to the first opening.

9. The drinking system of claim 1, wherein, as viewed from above, the second opening is not tangent with the first opening.

10. The drinking system of claim 1, further comprising the drinking container.

11. A drinking system comprising:
- a lid for a drinking container, the lid with a body having a spout with
  - a first opening configured for pouring a liquid from the drinking container to a user's mouth, the first opening having a diameter;
  - a second opening configured to retain a straw so that a user can sip liquid from the drinking container, the second opening located within the first opening and having a diameter smaller than the first opening diameter; and
- a straw assembly configured to at least partially insert into the second opening and comprised of a straw and a mouthpiece adjacent an end of the straw;
- wherein the straw assembly is configured to stop and bypass the first opening.

12. The drinking system of claim 11, wherein the mouthpiece is formed of a flexible material.

13. The drinking system of claim 11, wherein a top surface of the second opening is below a top surface of the first opening.

14. The drinking system of claim 11, wherein the spout has a recess that is configured to accommodate a user's lower lip.

15. The drinking system of claim 11, wherein the second opening is circular in shape and the first opening is elliptical in shape.

16. The drinking system of claim 11, wherein, as viewed from above, the second opening is not tangent with the first opening.

17. The drinking system of claim 11, further comprising the drinking container.

18. A drinking system comprising:
- a lid for a drinking container, the lid with
  - a body having a spout with
    - a first opening configured for pouring a liquid from the drinking container to a user's mouth, the first opening having a diameter,
    - a second opening configured to retain a straw so that a user can sip a liquid from the drinking container, the second opening located within the first opening and having a diameter smaller than the first opening diameter,
  - a first pivotably releaseable cover on top of the body, and
  - a second pivotably releasable cover between the first pivotably releasable cover and the first opening; and
- a straw assembly configured to at least partially insert into the second opening and comprised of a straw and a mouthpiece adjacent an end of the straw, the straw assembly configured to stop and bypass the first opening.

19. The drinking system of claim 18, the mouthpiece releaseably retainable within the second pivotably releasable cover.

20. The drinking system of claim 18, further having a pushbutton latch assembly configured to releasably retain the first pivotably releasable cover.

21. The drinking system of claim 20, the pushbutton latch assembly having a first stage wherein the first pivotably releasable cover is ajarred for releasing pressure within the drinking system when a user depresses a button within the pushbutton latch assembly.

22. The drinking system of claim 21, wherein the ajarred first pivotably releaseable cover generally impedes pressurized liquid from spilling from the container.

23. The drinking system of claim 21, the pushbutton latch assembly having a second stage wherein the first pivotably releaseable cover fully opens when a user depresses the button within the pushbutton latch assembly.

24. The drinking system of claim 18, further comprising a pivotable carry loop.

25. The drinking system of claim 18, wherein a top surface of the second opening is below a top surface of the first drinking opening.

26. The drinking system of claim 18, wherein the spout has a recess that is configured to accommodate a user's lower lip.

27. The drinking system of claim 18, wherein the second opening is circular in shape.

28. The drinking system of claim 18, wherein the first opening is elliptical in shape.

29. The drinking system of claim 18, further comprising a bracket that connects the second opening to the first opening.

30. The drinking system of claim 18, wherein, as viewed from above, the second opening is not tangent with the first opening.

31. The drinking system of claim 18, further comprising the drinking container.

32. A drinking system comprising:

a lid for a drinking container, the lid with a body having a spout with a first opening configured for pouring a liquid from the container to a user's mouth, a second opening configured to retain a straw so that a user can sip liquid from the container, and a first pivotably releaseable cover on top of the body, and a second pivotably releasable cover between the first pivotably releasable cover and the first opening; and a straw assembly configured to at least partially insert into the second opening and comprised of a straw and a mouthpiece adjacent an end of the straw, the straw assembly configured to stop and bypass the first opening.

33. The drinking system of claim 32, further having a pushbutton latch assembly configured to releasably retain the first pivotably releasable cover.

34. The drinking system of claim 32, the pushbutton latch assembly having a first stage wherein the first pivotably releasable cover is ajarred for releasing pressure within the drinking container when a user depresses a button within the pushbutton latch assembly.

35. The drinking system of claim 32, wherein the ajarred first pivotably releaseable cover generally impedes pressurized liquid from spilling from the container.

36. The drinking system of claim 34, the pushbutton latch assembly having a second stage wherein the first pivotably releaseable cover fully opens when a user depresses the button within the pushbutton latch assembly.

37. The drinking system of claim 32 further comprising the drinking container.

* * * * *